US006012512A

United States Patent [19]

Ghiani

[11] Patent Number: 6,012,512

[45] Date of Patent: Jan. 11, 2000

[54] HEAT EXCHANGER AS WELL AS HEAT EXCHANGER ARRANGEMENT FOR A MOTOR VEHICLE

[75] Inventor: Franco Ghiani, Bietigheim-Bissingen, Germany

[73] Assignee: Behr GmbH & Co., Stuttgart, Germany

[21] Appl. No.: 09/085,757

[22] Filed: May 27, 1998

[30] Foreign Application Priority Data

May 27, 1997 [DE] Germany ..... 197 22 097

[51] Int. Cl.[7] ..... F28D 7/10

[52] U.S. Cl. ..... 165/140; 165/153; 165/179

[58] Field of Search ..... 165/140, 153, 165/173, 179, 175; 29/890.052, 890.03

[56] References Cited

U.S. PATENT DOCUMENTS

| | | | |
|---|---|---|---|
| 713,776 | 11/1902 | Lamplough | 165/153 |
| 1,365,930 | 1/1921 | Martin | 165/153 |
| 1,899,080 | 2/1933 | Dalgliesh | 165/153 |
| 3,265,126 | 8/1966 | Donaldson | 165/140 |
| 4,159,034 | 6/1979 | Bellovary et al. | 165/153 |
| 4,183,402 | 1/1980 | Cotter . | |
| 4,206,806 | 6/1980 | Togashi . | |
| 4,470,452 | 9/1984 | Rhodes | 165/153 |
| 4,546,824 | 10/1985 | Melnyk | 165/153 |
| 4,815,535 | 3/1989 | Hagemeister . | |
| 5,033,540 | 7/1991 | Tategami et al. | 165/135 |
| 5,509,199 | 4/1996 | Beamer et al. . | |
| 5,579,832 | 12/1996 | Le Gauyer | 165/175 |

FOREIGN PATENT DOCUMENTS

| | | |
|---|---|---|
| 0253167 | 1/1988 | European Pat. Off. . |
| 541 805 A1 | 5/1993 | European Pat. Off. . |
| 788901 | 10/1935 | France . |
| 914783 | 10/1946 | France . |
| 1277282 | 9/1968 | Germany . |
| 7229162 | 10/1973 | Germany . |
| 2423440 | 11/1975 | Germany . |
| 3834822 | 4/1990 | Germany . |
| 4012046 | 10/1991 | Germany . |
| 9111412 | 12/1991 | Germany . |
| 9400687 | 6/1995 | Germany . |
| 19501276 | 7/1996 | Germany . |
| 19543986 | 5/1997 | Germany . |
| 185245 | 7/1936 | Switzerland . |
| 378353 | 7/1964 | Switzerland . |

*Primary Examiner*—Ira S. Lazarus
*Assistant Examiner*—Terrell McKinnon
*Attorney, Agent, or Firm*—Evenson, McKeown, Edwards & Lenahan, P.L.L.C.

[57] ABSTRACT

A heat exchanger for a motor vehicle includes a fin/tube block with flat tubes which are provided on opposite sides with tube ends. The tube ends are widened such that transversely extending, mutually adjacent wall sections of the tube ends flatly adjoin one another and the tube ends of a row are aligned with one another. One flow box is placed on the tube ends on each side of the fin/tube block. Each of the flow boxes ends flush with corresponding longitudinally extending wall sections of the tube ends. The transversely extending, mutually adjacent wall sections of the tube ends adjoin one another in a form-locking manner.

7 Claims, 7 Drawing Sheets

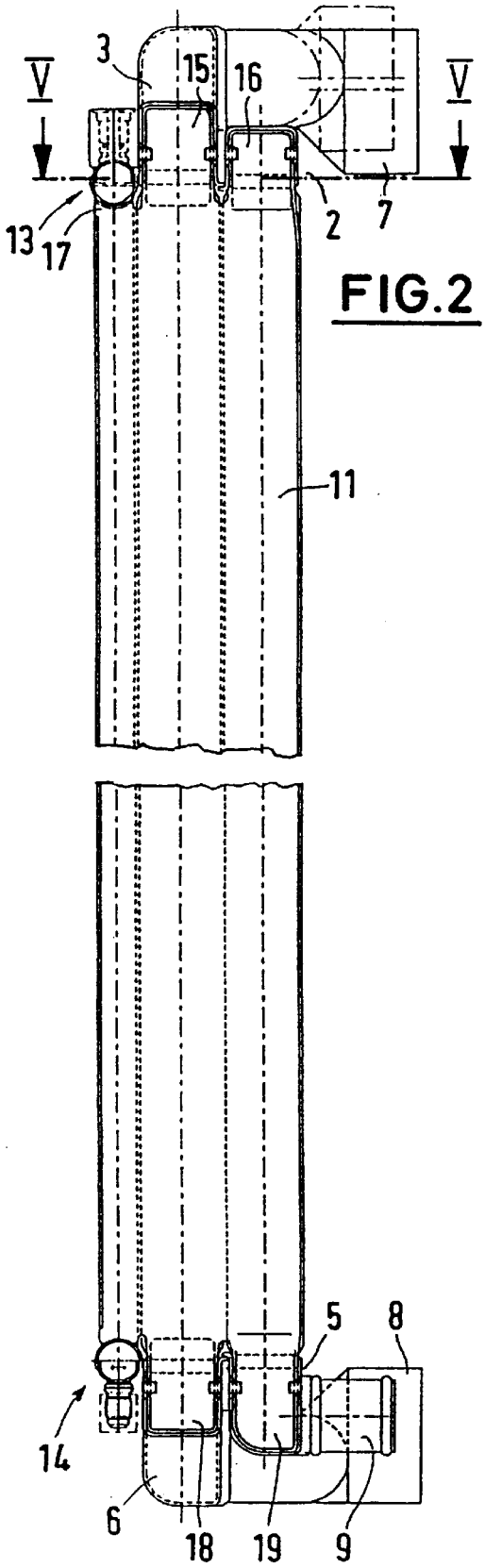
FIG.2
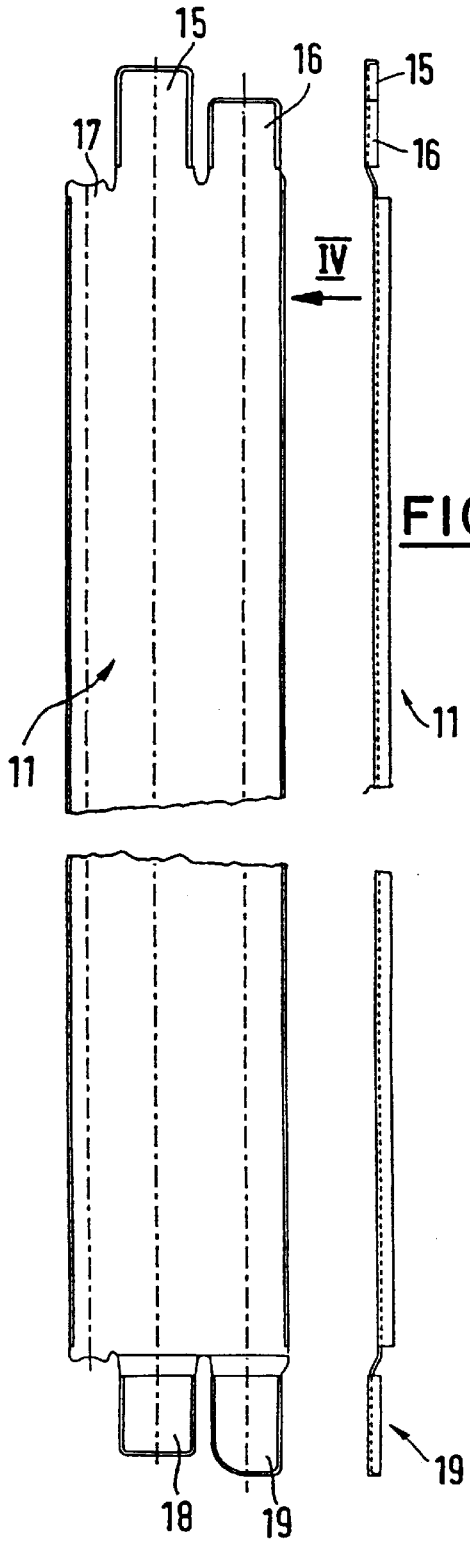
FIG.4
FIG.3

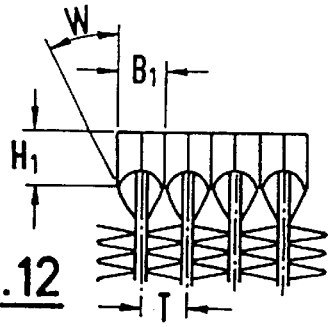
FIG.12
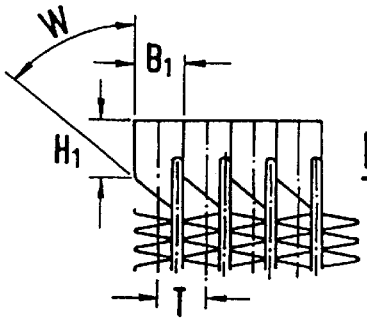
FIG.13
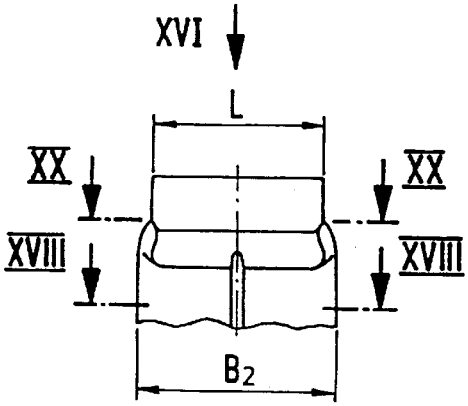
FIG.14
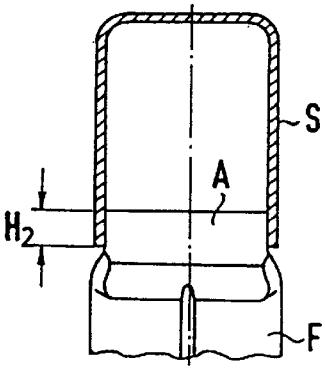
FIG.15
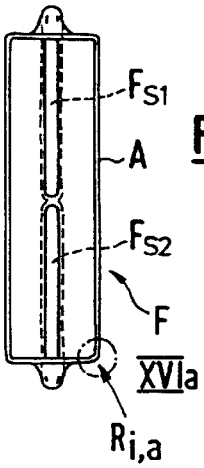
FIG.16
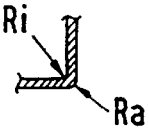
FIG.16 a
FIG.17
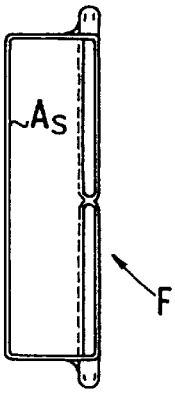
FIG.18
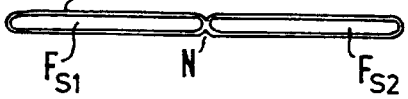
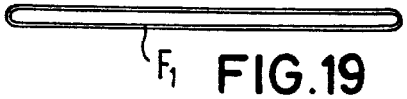
FIG.19
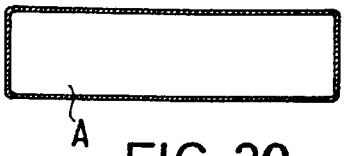
FIG.20

HEAT EXCHANGER AS WELL AS HEAT EXCHANGER ARRANGEMENT FOR A MOTOR VEHICLE

BACKGROUND OF THE INVENTION

This application claims the priority of German Patent Application No. 197 22 097.5, filed May 27, 1997, the disclosure of which is expressly incorporated by reference herein.

This invention relates to a heat exchanger for a motor vehicle, having a fin/tube block with flat tubes which are provided on opposite sides with tube ends which are widened such that transversely extending, mutually adjacent wall sections of the tube ends flatly adjoin one another and the tube ends of a row are aligned with one another, one flow box or tank respectively being placed on the tube ends on both sides and ending flush with corresponding longitudinally extending wall sections of the tube ends, and to a heat exchanger arrangement for a motor vehicle having at least two heat exchangers arranged next to one another in a flow-through direction.

German Patent Application DE 195 43 986.4, which is not a prior publication, describes a heat exchanger which has a fin/tube block with flat tubes with tube ends which are widened to respective rectangular cross-sections. The tube ends are widened such that they adjoin one another flatly with their wall sections extending transversely to the longitudinal direction of fitted-on flow boxes or tanks, and such that the respective lateral longitudinally extending wall sections of the tube ends are aligned with one another and end flush with the corresponding wall areas of the fitted-on flow tanks. By brazing together the adjoining wall sections and wall areas, the sealing of the flow tanks is achieved. The flow tanks are used as collector or distributor tanks. In addition, this German application, which is not a prior publication, discloses a heat exchanger arrangement having two heat exchangers, one constructed as a vehicle radiator and the other constructed as a condenser. These two heat exchangers are arranged directly next to one another in the flow-through direction of the air and are connected with one another in the area of the respective flow tanks by corresponding connecting devices.

It is a primary object of the invention to provide a heat exchanger as well as a heat exchanger arrangement of the initially mentioned type which permits operationally reliable manufacturing and a simple and space-saving construction.

With respect to the heat exchanger, this object is achieved in that the mutually adjacent, transversely extending wall sections of the tube ends adjoin one another in a form-locking manner. It is therefore possible to achieve a precise mutual alignment and fixing of the tube ends during pre-assembly of the heat exchanger, that is, before the brazing-together of the individual components. Tolerances as the result of a lateral offset of individual tube ends can be avoided. In addition, the form-locking contact of the wall sections with one another results in an enlarged contact surface which in turn results in increased safety of the brazed connection.

According to one feature of preferred embodiments of the invention, the longitudinally extending wall sections of the tube ends which face flow boxes or flow tanks form-lockingly adjoin corresponding wall sections of the flow boxes or flow tanks. This further improves the pre-assembly of the heat exchanger because the flow boxes, relative to their longitudinal direction, can also be fitted onto the tube ends in a precisely positioned manner and can be fixed in the longitudinal direction by the form closure. In addition, the form-locking contact ensures an enlarged contact surface which further improves the tightness and the safety of the subsequent brazed connection between the flow boxes and the tube ends.

According to a further feature of preferred embodiments of the invention, the corners of the widened tube ends are provided with radii between 0 and 2 mm. In this case, the widened tube ends preferably have a rectangular shape and can additionally be provided with correspondingly shaped wall sections. The preferred radii ensure that only extremely narrow gaps remain between the adjacent tube ends also in the area of the exterior sides. These gaps can be completely filled by brazing during the brazing operation so that the tight brazed connection is ensured mutually and particularly with respect to the lateral wall areas of the flow boxes.

According to a further feature of preferred embodiments of the invention, the tube ends are each widened asymmetrically with respect to the longitudinal center planes of the assigned flat tubes. As a result, it is possible to implement special arrangements of components of the heat exchanger without affecting reliable functioning of the heat exchanger.

According to a further feature of preferred embodiments of the invention, the circumference of the widening of each tube end corresponds to the circumference of the assigned flat tube, plus or minus 30%. The negative relationship between the circumference of each flat tube and the circumference of the assigned widened tube end is the particular result of a folding of the wall of the tube ends which is double-walled in sections.

According to a further feature of preferred embodiments of the invention, the transverse-side wall sections which face the adjoining tube ends have a height $H_1$ between 0.3 and 2 times a separation distance T of the flat tubes, specifically $0.3T \leqq H_1 \leqq 2T$. This preferred dimensioning range permits a secure, tight connection between the tube ends as well as a sufficient stability of the whole fin/tube block.

According to a further feature of preferred embodiments of the invention, the flat tubes are aligned relative to the axis of symmetry of the widened tube ends in a diagonally extending manner. This further feature also permits a special arrangement of the heat exchanger in a motor vehicle, in which a diagonal arrangement of the heat exchanger within an engine compartment of the motor vehicle—relative to the normal driving direction of the motor vehicle—is advantageous.

With respect to the heat exchanger arrangement, the primary object of the invention is achieved by respectively assigning one common lateral part to the at least two heat exchangers on opposite sides. By using the common lateral parts, a simple and secure connection of the heat exchangers relative to one another is achieved, on the one hand, and a precise positioning relative to one another is achieved, on the other hand. Furthermore, simplified assembly and manufacturing are achieved for the heat exchanger arrangement with a reduced number of components.

According to a further feature of preferred embodiments of the invention, the flow boxes of at least one heat exchanger are designed to be open in their lateral areas, and the opposite lateral parts are each provided with at least one corresponding end section which projects into the respective lateral parts of the flow boxes and tightly closes the flow boxes off. As a result, it is possible to provide the flow boxes with a simple design because the tanks can be deep-drawn as simple U-profiles.

According to another feature of preferred embodiments of the invention, at least two heat exchangers have common fins extending along the total depth of the fin/tube block. This results in a simplified construction of the heat exchanger arrangement because the number of components is reduced and the fins directly establish the connection of the heat exchangers among one another.

According to yet another feature of preferred embodiments of the invention, the flow boxes of the at least two heat exchangers are provided with connecting sleeves which are aligned parallel to one another and in the same direction in a curved manner. This results in an arrangement of the connecting sleeves which is advantageous for the flow and also has a space-saving effect.

According to a further feature of preferred embodiments of the invention, insulation gaps are arranged between the tubes and/or the flow boxes. These insulation gaps are used for thermal insulation of adjacent heat exchangers with respect to one another, and the insulation gaps in each case separate the tubes from one another preferably along their whole lengths to the respective flow boxes. This further feature also includes the use of insulation gaps which are provided only in sections between the adjacent tubes and/or flow boxes. The insulation gaps preferably have widths between 1 and 10 mm.

Additional advantages and characteristics of preferred embodiments of the invention are reflected in the claims as well as in the following description of preferred embodiments of the invention which are illustrated by the drawings.

BRIEF DESCRIPTION OF THE DRAWINGS

FIG. 2 is lateral view of the heat exchanger arrangement according to FIG. 1;

FIG. 3 is a view of a common lateral part for the heat exchanger arrangement according to FIGS. 1 and 2;

FIG. 4 is a view of the lateral part according to FIG. 3 in the direction of the arrow IV in FIG. 3;

FIG. 12 is a schematic view of a cutout of a fin/tube block in the area of widened tube ends;

FIG. 13 is a view of another cutout of a fin/tube block similar to FIG. 12 with asymmetrically widened tube ends;

FIG. 14 is a view of a cutout of a flat tube according to FIG. 12 in the area of its widened tube end;

FIG. 15 is a schematic sectional view of a water box which is used as a flow box and which is placed on widened tube ends of flat tubes;

FIG. 16 is a top view of the flat tube according to FIG. 14 in the direction of the arrow XVI in FIG. 14;

FIG. 16*a* is a view of an enlarged cutout of the flat tube according to FIG. 16 in the area XVIa in FIG. 16;

FIG. 17 is another top view in FIG. 16 but of an asymmetrically widened flat tube;

FIG. 18 is a sectional view of the flat tube according to FIG. 14 along the section line XVIII in FIG. 14;

FIG. 19 is a sectional view of another flat tube similar to FIG. 18;

FIG. 20 is a sectional view of the flat tube according to FIG. 14 in the area of its widened tube end along the section line XX—XX in FIG. 14;

DESCRIPTION OF THE PREFERRED EMBODIMENTS

Figure 1:
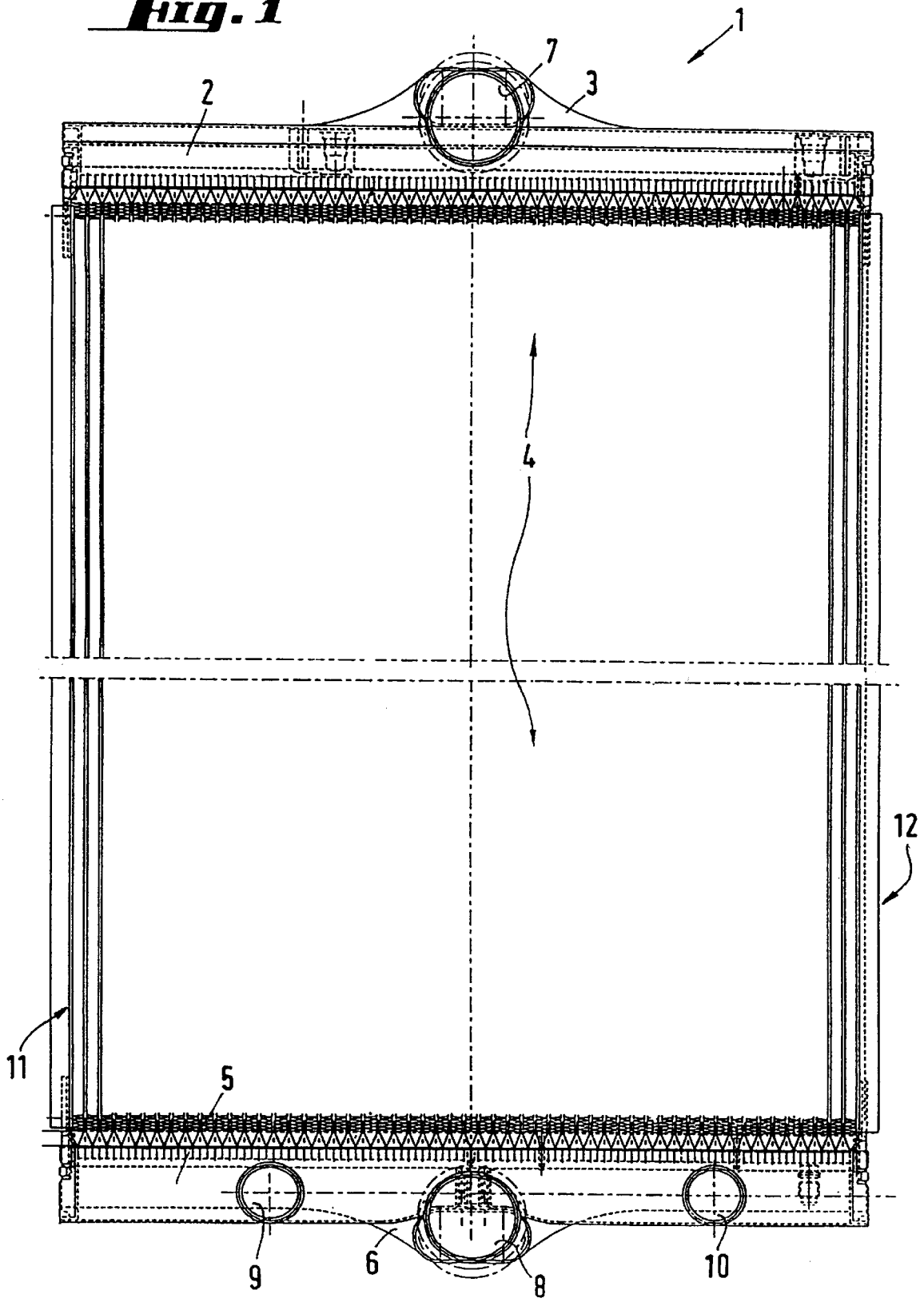
FIG. 1 is a frontal view of an embodiment of a heat exchanger arrangement according to the invention which is composed of three different heat exchangers.

A heat exchanger arrangement 1 for a motor vehicle according to FIGS. 1 to 5 has a first heat exchanger in the form of a water/air radiator, a second heat exchanger in the form of a charge air radiator, and a third heat exchanger in the form of a condenser. The three heat exchangers are arranged parallel to one another and transversely to the longitudinal direction of the vehicle in an engine compartment of the motor vehicle so that they are arranged next to one another in the flow-through direction of the air stream in the case of a normal driving direction of the motor vehicle. The water/air radiator has a water box 2 which is on top in FIG. 1 and is used as a flow box. The water/air radiator also has a lower water box 5 which is also used as a flow box. Two connecting sleeves 9 and 10 for connecting the water/air radiator to the corresponding cooling water circulating system are arranged on the lower water box 5. A fin/tube block 4, with a construction and a connection with the water boxes 2 and 5 that will be described in detail in the following, extends between the two water boxes 2 and 5. The charge air radiator is arranged behind the water/air radiator and has an upper air receiver 3 used as a flow box as well as a corresponding lower air receiver 6. Between the two air receivers 3 and 6, analogously to the water/air radiator, a fin/tube block is provided. The fin/tube block is not shown in detail and has a construction and connection with the air receivers 3 and 6 that corresponds to the construction of the water/air radiator. Behind the charge air radiator, the condenser is positioned. The condenser has an upper flow box 13 as well as a lower flow box 14 and a fin/tube block which is not shown in detail and extends between these flow boxes 13, 14. Each flow box 13, 14 is formed by two half shells assembled to a round hollow chamber profile, and one half shell respectively represents a bottom of the respective flow box 13, 14 and is provided with indentations for tight connection to the tube ends of the flat tubes. Laterally, the flow boxes 13, 14 are each tightly closed by a cover insert.

The fin/tube block of the charge air radiator and the fin/tube block of the water/air radiator are composed of a plurality of mutually parallel flat tubes as well as corrugated fins arranged between the latter. The opposite tube ends of the flat tubes are each rectangularly widened so that, according to FIG. 1, the tube ends flatly and tightly adjoin one another in one row respectively with their wall sections which extend transversely in the longitudinal direction of the flow boxes. The longitudinally extending wall sections of the widened tube ends each extend in an alignment with respect to one another. Corresponding and longitudinally extending wall areas of the flow boxes rest flatly and in a flushly closing-off manner against these longitudinally extending wall sections of the tube ends which each form the exterior sides of the fin/tube block. The widened tube ends therefore directly form the "bottoms" of the flow boxes so that the additional operation of providing bottoms in the area of the flow boxes is avoided. The described construction of the heat exchangers corresponds to the design of the tube ends and the fitting-on of the flow boxes, as described in German Patent Application DE 195 43 986.4, which is not a prior publication.

On their opposite side areas, the flow boxes of the charge air radiator as well as the of the water/air radiator each have an open design. Each end section 15, 16, 18, 19 of a lateral part 11, 12 extends in one piece along the whole depth of the heat exchanger arrangement and thus along all three heat exchangers and is, in each case, used as the lateral end of these lateral areas of the flow boxes. The two lateral parts 11, 12 bound the fin/tube blocks of the water/air radiator, of the charge air radiator and of the condenser on opposite sides. The end sections 15, 16, 18, 19 of each lateral part 11, 12 project as extensions of the lateral parts into the lateral areas of the flow boxes, in which case the outer contours of the end sections 15, 16, 18, 19 are each precisely adapted to the inner contours of the lateral areas of the flow boxes so that a surrounding tight contact of the end sections 15, 16, 18, 19 is obtained on the corresponding interior walls of the flow boxes.

For stabilizing the end sections 15, 16, 18, 19 and for enlarging the flat surrounding contact of the end sections 15, 16, 18, 19 on the respective interior walls of the flow boxes, each of the end sections has one contact web in its edge area. This contact web extends along the walls of the flow boxes and projects at a right angle with respect to the surface of the respective lateral part 11, 12 and thus parallel to the interior walls of the respective flow box. In the area of the flow boxes 13, 14 of the condenser, the lateral parts 11, 12 only have one contact section 17 which is supported on a lower edge of the respective half shell of the flow boxes 13, 14 and thus carries out no lateral sealing function. As described above, the lateral sealing functions of the flow boxes 13, 14 are carried out by corresponding lateral closing covers which are tightly inserted into the hollow chamber profiles of the flow boxes 13, 14. For the assembly of the heat exchanger arrangement, the two lateral parts 11, 12 are fitted onto the fin/tube blocks from opposite sides and are simultaneously inserted by their end sections 15, 16, 18, 19 axially—relative to the longitudinal direction of the flow boxes—into the flow boxes. A tensioning device, such as tightening straps or the like, is used to load the whole heat exchanger arrangement, including the lateral parts 11, 12, by pressure in the transverse direction of the fin/tube blocks, and the arrangement is then tightly brazed together in a common brazing process. Naturally, it is necessary for this purpose to make all components of the heat exchanger arrangement 1 of sheet metal and preferably of an aluminum alloy. At least the sections of the individual components of the heat exchanger arrangement which must in each case be fitted together tightly are correspondingly solder-plated. In order to fix the lateral parts 11, 12 already in their pre-assembly stage in the lateral areas of the flow boxes, holding claws are provided on the opposite front edges of the flow boxes. In the embodiment according to FIG. 7, these claws are indicated by the reference number 26. After the axial sliding-in of the end sections of the lateral parts 11, 12, these holding claws are bent toward the inside so that they engage in corresponding recesses of the contact webs of the end sections 15, 16, 18, 19. Also without the described tensioning device, by way of the lateral parts 11, 12, fixing of the flow boxes of the charge air radiator and of the water/air radiator relative to the pertaining fin/tube blocks and relative to the lateral parts 11, 12 is already achieved.

Figure 5:
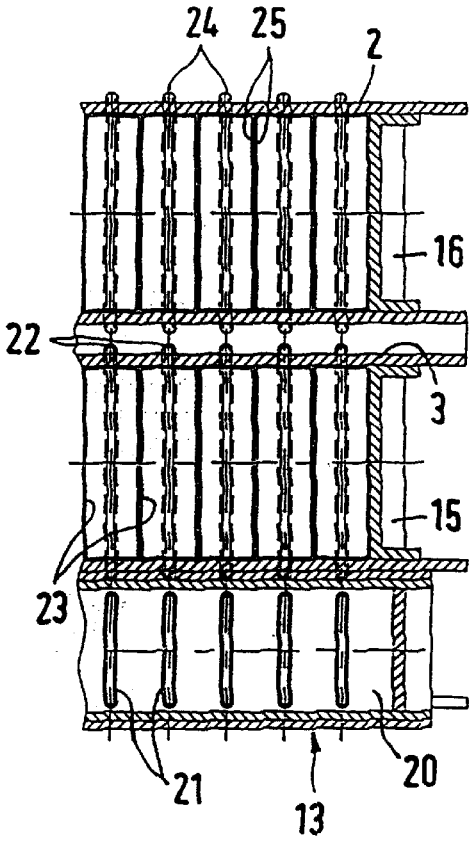
FIG. 5 is a sectional view of the heat exchanger arrangement according to FIGS. 1 and 2 along the section line V—V in FIG. 2.

As illustrated in the representation according to FIG. 5, by directly fitting the flow boxes onto the widened tube ends, on the one hand, and providing common, one-piece lateral parts 11, 12, on the other hand, an extremely narrow, compact construction of the heat exchanger arrangement is obtained. In this case, extremely small distances remain between the individual flat tubes 21, 22, 24 of the condenser, of the charge air radiator and of the water/air radiator and, therefore, between the respective fin/tube blocks. Since the charge air radiator and the water/air radiator are separated from one another in the areas of the flow boxes, a good thermal insulation between the adjacent flow boxes is obtained in these areas. In addition, FIG. 5 shows that the flat tubes 21 of the condenser project through a bottom 20 of the pertaining flow box 13 and are fixed in the flow box 13 by this bottom 20.

Figure 6:
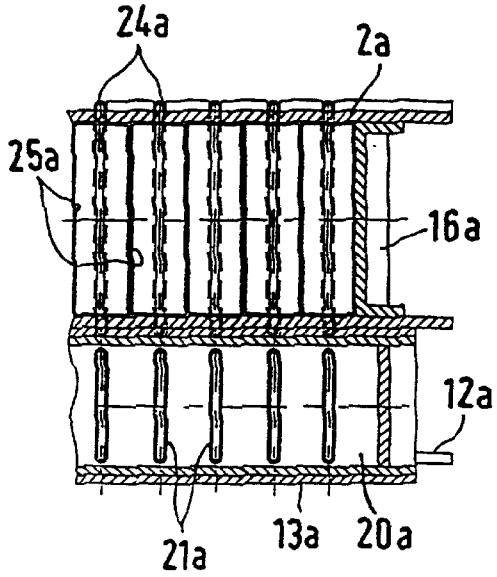
FIG. 6 is a sectional view of another heat exchanger arrangement according to FIG. 7 along section line VI—VI in FIG. 7.
Figure 7:
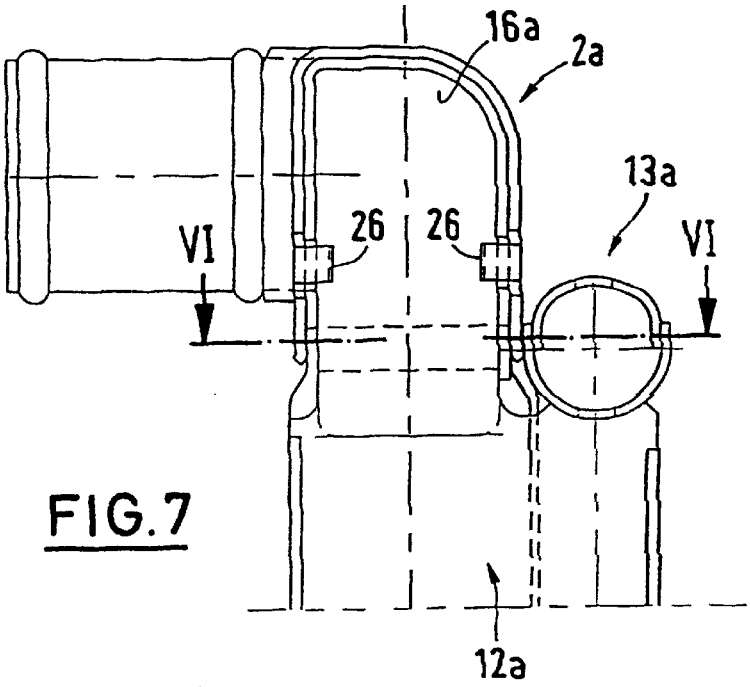
FIG. 7 is a lateral view of the additional heat exchanger arrangement which has two different heat exchangers with a common lateral part.
Figure 8:
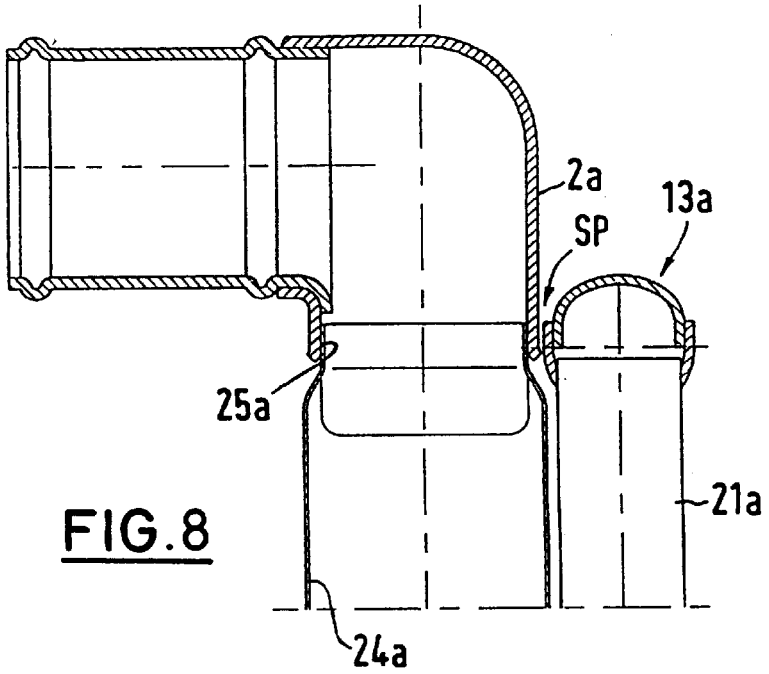
FIG. 8 is a longitudinal sectional view of the heat exchanger arrangement according to FIG. 7.

Another heat exchanger arrangement according to FIGS. 6 to 8 only has two heat exchangers arranged next to one another. One of these heat exchangers is constructed as a water/air radiator and the other is constructed as a condenser. In its construction, the water/air radiator corresponds to the water/air radiator of the heat exchanger arrangement 1 which was described above in detail in connection with FIGS. 1 to 5 so that no further explanations are required in this regard. The same applies to the construction of the condenser according to FIGS. 6 to 8. Two common lateral parts 12*a* are also assigned, on opposite sides, to the water/air radiator and the condenser. The lateral parts 12*a* basically correspond in design to the lateral parts 11 and 12 but only for two heat exchangers. Each lateral part 12*a* has only one respective end section 16*a* for the respective lateral area of the water box of the water/air radiator. Each lateral part 12*a*, analogously to the design according to FIGS. 1 to 5, is fixed by holding claws 26 in the lateral areas and is subsequently tightly brazed to the water boxes. The compact construction of the heat exchanger arrangement as well as the analogous design with respect to the heat exchanger arrangement according to FIGS. 1 to 5 is shown in FIGS. 6 to 8. In FIGS. 1 to 5 and in FIGS. 6 to 8, identical reference numbers are used for the same components but with the addition of the letter "a" in FIGS. 6 to 8.

Figure 9:
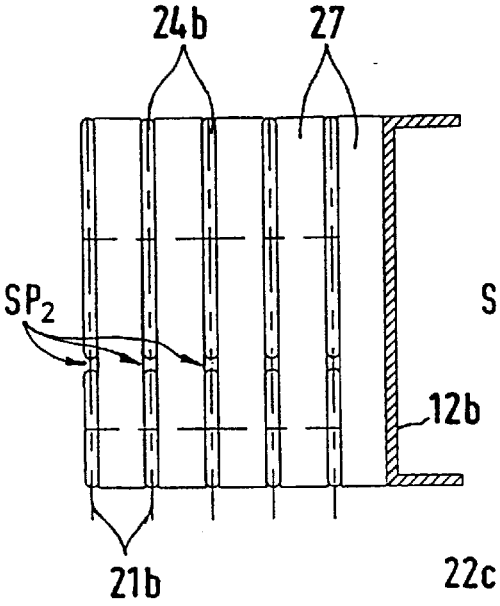
FIG. 9 is a schematic cross-sectional view at the level of a fin/tube block of a heat exchanger arrangement similar to FIGS. 7 and 8.

In the embodiment according to FIG. 9, a heat exchanger arrangement is shown in sections which are similar to FIGS. 6 to 8 and which is also preferably composed of a water/air radiator and a condenser. An important difference with respect to the embodiment according to FIGS. 6 to 8 is that this heat exchanger arrangement has a particular common fin/tube block. Although the flat tubes 21*b* of the condenser, on the one hand, and the flat tubes 24*b* of the water/air radiator, on the other hand, are separated from one another, the common fin/tube block has common corrugated fins 27 which are continuous along the whole depth of the heat exchanger arrangement. The corrugated fins 27 therefore have the same width as the lateral parts 12*b* which also extend along the whole heat exchanger arrangement.

Figure 10:
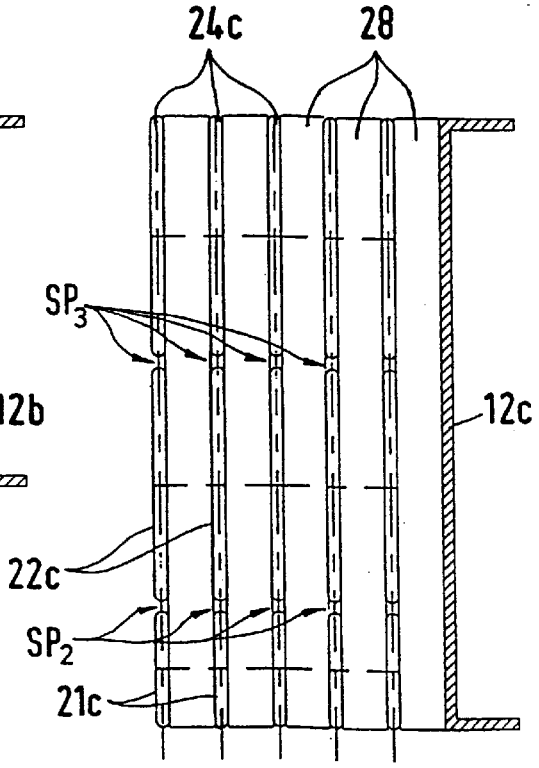
FIG. 10 is another schematic cross-sectional view of a head exchanger arrangement similar to FIGS. 1, 2 and 5 in the area of a common fin/tube block.

The heat exchanger arrangement according to FIG. 10 is analogous to the heat exchanger arrangement according to FIG. 9 and is also provided with a common fin/tube block in which corrugated fins 28 extend along the whole depth of the heat exchanger arrangement. However, in this embodiment, three heat exchangers, preferably in the form of a water/air radiator, a charge air radiator and a condenser, are again combined in the heat exchanger arrangement and are held together by respective one-piece lateral parts 12*c*, which continue along the whole depth of the heat exchanger arrangement, analogous to the embodiment according to FIGS. 1 to 5. In this heat exchanger arrangement, the flat tubes 24*c* of the first heat exchanger, the flat tubes 22*c* of the second heat exchanger, and the flat tubes 21*c* of the third heat exchanger are, in each case, arranged at short distances from one another. However, the flat tubes 21*c*, 22*c*, 24*c* are connected with one another by corrugated fins 28 which extend in parallel between them and along the whole width of the flat tubes 21*c*, 22*c* and 24*c*.

Figure 11:
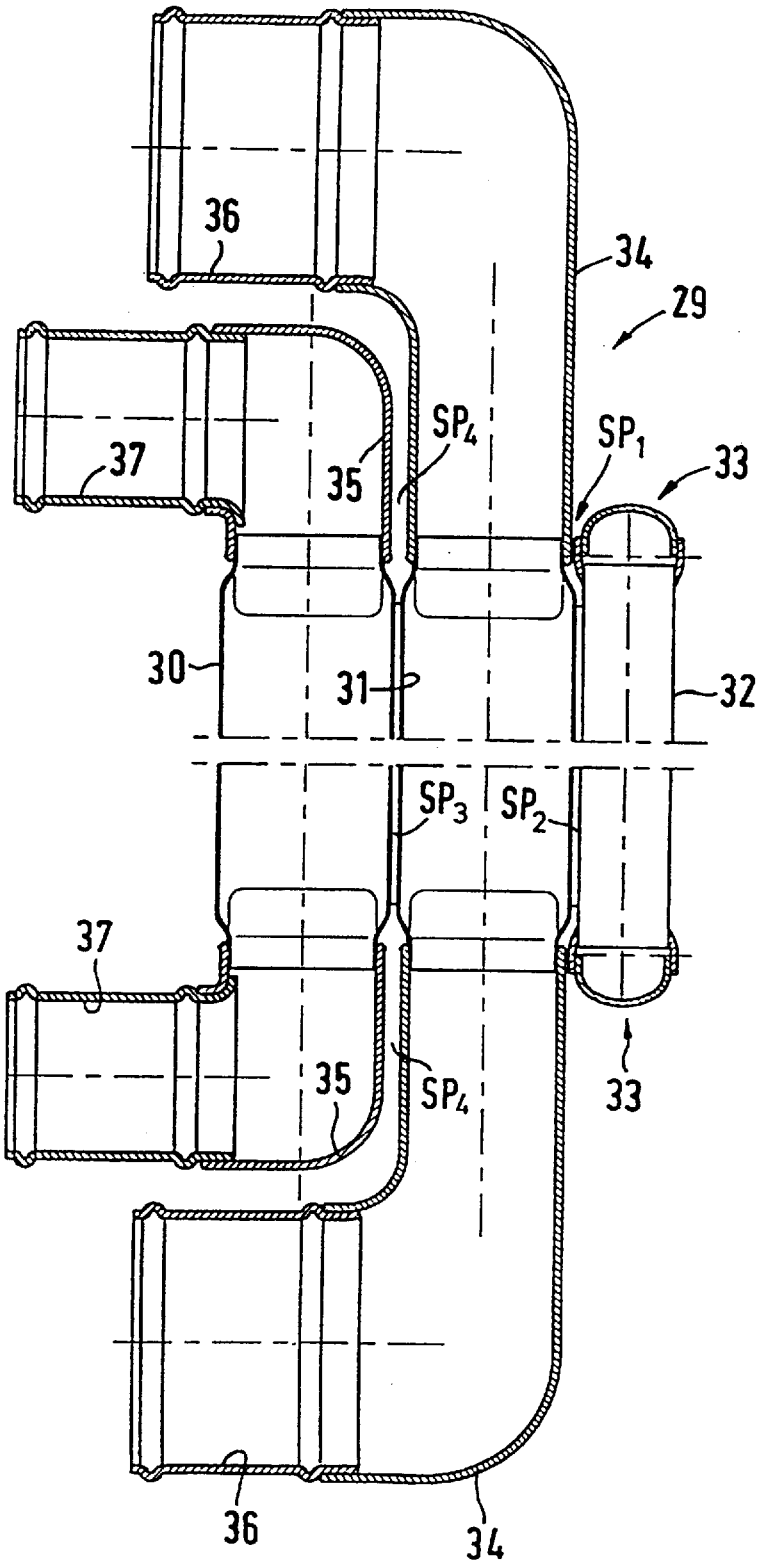
FIG. 11 is a longitudinal sectional view of another embodiment of a heat exchanger arrangement according to the invention having three different heat exchangers which have fluidically advantageously and symmetrically arranged connecting sleeves.
Figure 21:
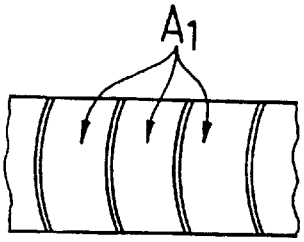
FIG. 21 is a schematic top view of widened tube ends of a fin/tube block.
Figure 22:
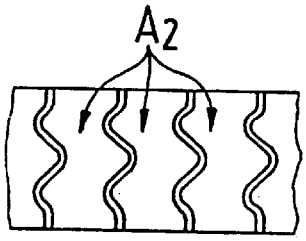
FIG. 22 is a schematic view of widened tube ends of another fin/tube block similar to FIG. 21.
Figure 23:
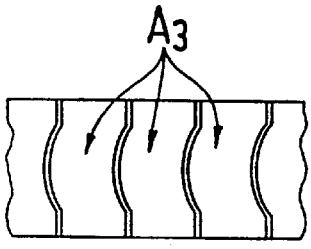
FIG. 23 is a schematic top view of widened tube ends of another fin/tube block similar to FIG. 21.

The construction of the heat exchanger arrangement 29 according to FIG. 11 basically corresponds to the embodiment according to FIGS. 1 to 5 or FIG. 10. A water/air radiator has flat tubes 30 of a fin/tube block not shown in detail. Water boxes 35 are fitted directly onto the widened tube ends of this fin/tube block. The water boxes 35 have mutually identical and symmetrical designs, and each has a connecting sleeve 37. The connecting sleeves, according to the representation of FIG. 11, extend in parallel to one another in the same direction. The charge air radiator has flat tubes 31 of an assigned fin/tube block which are designed analogous to the water/air radiator. One air receiver 34 respectively is fitted on opposite sides onto the widened tube ends of the flat tubes 31. The air receivers 34 on the opposite sides of the charge air radiator are also designed identically and symmetrically with respect to one another. Each of the air receivers 34 has a connecting elbow which is, in each case, curved above and below the respective water box 35 symmetrically to the water/air radiator so that the inserted connecting sleeves 36 are aligned in parallel to the connecting sleeves 37 of the water/air radiator. This results in a design of the heat exchanger arrangement which is particularly advantageous with respect to the flow. Because of the symmetrical identical construction of the opposite flow boxes, a simplified manufacturing of the heat exchanger arrangement is permitted in particularly high piece numbers. The condenser, which is composed of flow boxes 33 and a fin/tube block having flat tubes 32, also has a symmetrical construction with respect to a transverse center plane (shown by a dash-dotted line) of the heat exchanger arrangement. The individual heat exchangers according to FIG. 11 are fixedly connected with one another by common lateral parts and/or by way of corrugated fins extending along the whole depth of the heat exchanger arrangement 29 and form a combined block analogously to the above-described embodiments. In all embodiments, all components of the heat exchangers and the heat exchanger arrangement are made of metal for brazing in a joint brazing process.

The heat exchanger arrangements according to FIGS. 8 to 11 have flow boxes (water boxes 2*a* and flow boxes 13*a*, according to FIG. 8, and water boxes 35, air receivers 34 and flow boxes 33, according to FIG. 11) which are separated from one another by insulation gaps $SP_1$, $SP_4$. In this case, only a narrow insulation gap $SP_1$ of approximately 1 mm is provided between the water box 2*a* and the flow box 13*a* according to FIG. 8; the insulation gap between the water box 35 and the air receiver 34 is designed to be much larger. The insulation gaps have the purpose of avoiding heat transfers between the flow boxes which have different hot or warm temperatures during operation.

In addition or as an alternative, other insulation gaps $SP_2$ are provided between the tubes 21*b*, 24*b*, and insulation gaps $SP_2$ and by are provided between the tubes 21*c*, 22*c*, 24*c*. These insulation gaps are used for the thermal insulation of the adjacent tube blocks (FIGS. 9, 10). In the same fashion, insulation gaps $SP_2$, $SP_3$ are provided between the tubes 31, 32 and 30, 31 in the case of the heat exchanger arrangement according to FIG. 11.

All insulating gaps have a width between 1 mm and 10 mm.

A heat exchanger, formed by the water/air radiator as well as by the charge air radiator of the above-described embodiments, may have different details which, for a heat exchanger of the basically above-described construction, result in the further developments shown in FIGS. 12 to 27 and described in the following. Either by themselves or in optional combinations, these details can result in the respective further developments of the heat exchangers.

According to FIG. 12, each of the widened tube ends of the fin/tube block of a heat exchanger, which was basically described above, is provided with a rectangular bent-open area A, as illustrated in FIG. 20. In this case, the width L (FIG. 14) of the longitudinally extending wall section of each bent-open area A is smaller than the width $B_2$ (FIG. 14) of the pertaining flat tubes. The longitudinal-side wall sections, which extend in the longitudinal direction of the flow boxes, have a width $B_1$ which corresponds to the separation distance T of the fin/tube block. The height $H_1$ of the transversely extending wall sections of the bent-open areas A, which corresponds to the height of the contact surface of these wall sections on one another, is between 0.3 and 2 times the separation distance T of the fin/tube block. In this case selection is made from this range as a function of respective demands on the heat exchanger.

The transition area of each bent-open area A between the normal flat tube cross-section and the respective front end of the widened tube end has an angle of inclination W relative to the area of the transversely extending wall section of the bentopen area A. This angle of inclination W is between 5° and 90° and, preferably, between 25° and 65°. The transition area may be provided as an inclined plane or as a direct connection between two radii—from the flat tube, on one side, and from the bent-open area, on the other side. In this case, the angle of inclination W will then be determined by the common tangent of the two radii. As illustrated in FIG. 15, the height $H_2$ of the longitudinal-side wall sections of each bent-open area A, which is used for the flat brazed contact of the corresponding wall sections of the respective flow box S, is smaller than the height $H_1$ of the transverse-side wall sections. The ratio of these heights $H_1$ and $H_2$ is the result of the degree of bending-open of the area A relative to the flat tube F. Among other things, the degree of bending-open is defined by the ratio of the circumferences of the bent-open area A, on the one hand, and of the pertaining flat tube F, on the other hand. According to preferred embodiments, the circumference of the bent-open area A is dimensioned such that it corresponds to the circumference of the pertaining flat tube F plus or minus 30%.

The corners of the rectangular bent-open areas A of the flat tubes preferably have an outside radius $R_a$ and an inside radius $R_i$ (FIG. 16) which are between 0 and 2 mm. In this case, the outside radius $R_a$ is dimensioned such that only very narrow gaps remain between the adjacent tube ends and the lateral walls of the flow boxes. These narrow gaps are filled completely and tightly in the brazing furnace by flowing solder.

In the embodiment according to FIGS. 13 and 17, the tube ends of the flat tubes F of the fin/tube block are asymmetrically widened, which results in a bent-open area $A_S$ which is offset with respect to a longitudinal center plane of each flat tube F. The adjacent bent-open areas As adjoin one another according to FIG. 13 in order to achieve a tight mutual connection.

The flat tubes either form a single continuous flow duct according to the flat tube $F_1$ of FIG. 19 or are provided, according to the embodiment of FIGS. 14 to 18, with two mutually separated flow ducts ( $F_{S1}$, $F_{S2}$), in which case the illustrated flat tube F is constructed by corresponding longitudinally extending beads N on opposite sides. The two flow ducts can also be created by a correspondingly extruded aluminum profile. In an embodiment of the invention which is not shown, more than two flow ducts are provided in a flat tube.

The schematic representations according to FIGS. 21 to 27 show different embodiments which further improve the "bottomless" heat exchangers in which the flow boxes are placed directly on the widened tube ends of the fin/tube block. In the embodiments according to FIGS. 21 to 23 and 26, a form-locking fixing of the widened tube ends on one another transversely to the longitudinal direction of the flow boxes, which are not shown, is achieved by a corresponding shaping of the transverse-side wall sections of the widened tube ends $A_1$, $A_2$, $A_3$ and $A_6$. In the embodiment according to FIG. 21, each of the wall sections is correspondingly curved in an arched manner. In the embodiment according to FIG. 22, each of the wall sections is curved in an undulated manner. The wall sections of the embodiment of FIG. 23 have arched curvatures which extend between straight webs of the wall sections. In the embodiment according to FIG. 26, the wall sections also extend in undulated forms which extend to the transverse-side wall sections and do not change into straight webs, as in the embodiment according to FIG. 22.

Figure 24:
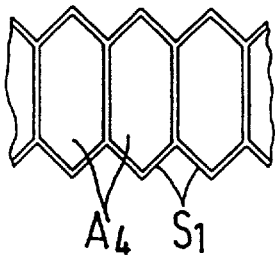
FIG. 24 is a schematic cross-sectional view of a heat exchanger in the area of widened tube ends and of a fitted-on flow box.
Figure 25:
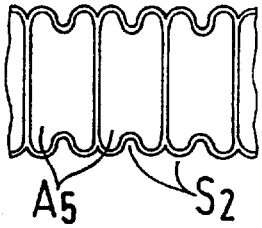
FIG. 25 is a schematic representation similar to FIG. 24 but in which the form-locking fixing of the flow box on the widened tube ends has a different design.
Figure 26:
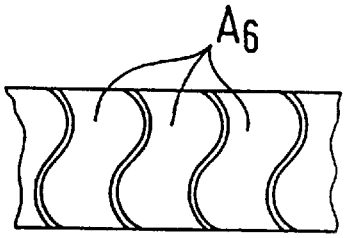
FIG. 26 is a schematic view of widened tube ends of a another fin/tube block similar to FIGS. 21 to 23.

In contrast to the embodiment according to FIG. 20, in the embodiments according to FIGS. 24 and 25, the transverse-side wall sections of the widened tube ends $A_4$ and $A_5$ have an unchanged straight-line and plane design. For this purpose, the longitudinal-side wall sections are widened in a V-shape toward the outside. In addition, the corresponding wall areas $S_1$ of the fitted-on flow box have a zigzag-type design so that a form closure is obtained in the longitudinal direction of the flow box between the widened tube ends $A_4$ and the wall areas of the respective flow box 1. In the embodiment according to FIG. 25, an undulated widening of the longitudinal-side wall sections of the widened tube ends $A_5$ is provided instead of a V-shaped widening. The corresponding wall areas of the flow box $S_2$ are analogously curved in an undulated manner, whereby a form closure between the flow box $S_2$ and the tube ends $A_5$ is achieved in the same manner as in the embodiment according to FIG. 24.

Figure 27:
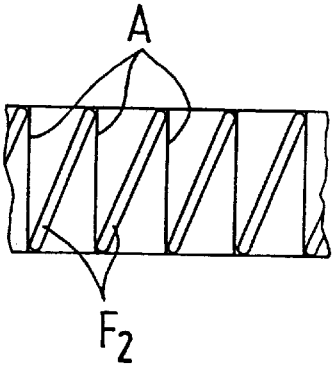
FIG. 27 is a schematic top view of a fin/tube block with widened tube ends and inclined flat tubes.

In the embodiment according to FIG. 27, the bent-open areas A of the flat tubes $F_2$ are obliquely, and preferably approximately diagonally, offset with respect to the longitudinal center planes of the flat tubes $F_2$ which, when flushly adjoining of the tube ends, results in the illustrated parallel and diagonal alignment of the flat tubes $F_2$.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Heat exchanger for a motor vehicle comprising:

a fin/tube block whose flat tubes are provided on opposite sides with tube ends which are widened such that transversely extending, mutually adjacent wall sections of the tube ends flatly adjoin one another and the tube ends of a row are aligned with one another, and one flow box respectively placed on the tube ends on each side of the fin/tube block and ending flush with corresponding longitudinally extending wall sections of the tube ends, wherein the transversely extending, mutually adjacent wall sections of the tube ends adjoin one another, and wherein the transversely extending, mutually adjacent wall sections of adjacent tube ends are provided with mutually corresponding undulated or arched curvatures.

2. Heat exchanger for a motor vehicle comprising:

a fin/tube block whose flat tubes are provided on opposite sides with tube ends which are widened such that transversely extending, mutually adjacent wall sections of the tube ends flatly adjoin one another and the tube ends of a row are aligned with one another, and one flow box respectively placed on the tube ends on each side of the fin/tube block and ending flush with corresponding longitudinally extending wall sections of the tube ends, wherein the transversely extending, mutually adjacent wall sections of the tube ends adjoin one another, and wherein the flat tubes are aligned to extend diagonally relative to axes of symmetry of the widened tube ends.

3. Heat exchanger arrangement for a motor vehicle comprising:

a heat exchanger including fin/tube block, whose flat tubes are provided on opposite sides with tube ends which are widened such that transversely extending, mutually adjacent wall sections of the tube ends flatly adjoin one another and the tube ends of a row are aligned with one another, and one flow box respectively placed on the tube ends on each side of the fin/tube block and ending flush with corresponding longitudinally extending wall sections of the tube ends, said heat exchanger being one of at least two heat exchangers arranged next to one another in a flow-through direction, and one common lateral part assigned to the at least two heat exchangers, wherein the flow boxes of at least one of the heat exchangers are designed to have open lateral areas, and wherein said one common lateral part is one of the opposite lateral parts, each provided with at least one corresponding end section projecting into respective lateral areas of the flow boxes to close the flow boxes off tightly.

4. Heat exchanger arrangement according to claim 3, wherein outside contours of the end sections are adapted to corresponding inside contours of the lateral areas of the flow boxes.

5. Heat exchanger arrangement for a motor vehicle comprising:

a heat exchanger including fin/tube block, whose flat tubes are provided on opposite sides with tube ends which are widened such that transversely extending, mutually adjacent wall sections of the tube ends flatly adjoin one another and the tube ends of a row are aligned with one another, and one flow box respectively placed on the tube ends on each side of the fin/tube block and ending flush with corresponding longitudinally extending wall sections of the tube ends, said heat exchanger being one of at least two heat exchangers arranged next to one another in a flow-through direction, and one common lateral part assigned to the at least two heat exchangers, wherein each of the flat tubes of at least one fin/tube block forms at least two mutually parallel flow ducts.

6. Heat exchanger for a motor vehicle comprising:

a fin/tube block whose flat tubes are provided on opposite sides with tube ends which are widened such that transversely extending, mutually adjacent wall sections of the tube ends flatly adjoin one another and the tube ends of a row are aligned with one another, and one flow box respectively placed on the tube ends on each side of the fin/tube block and ending flush with corresponding longitudinally extending wall sections of the tube ends, wherein the flat tubes are aligned to extend diagonally relative to axes of symmetry of the widened tube ends.

7. Heat exchanger arrangement for a motor vehicle comprising:

a heat exchanger including fin/tube block, whose flat tubes are provided on opposite sides with tube ends which are widened such that transversely extending, mutually adjacent wall sections of the tube ends flatly adjoin one another and the tube ends of a row are aligned with one another, and one flow box respectively placed on the tube ends on each side of the fin/tube block and ending flush with corresponding longitudinally extending wall sections of the tube ends, said heat exchanger being one of at least two heat exchangers arranged next to one another in a flow-through direction, wherein each of the flat tubes of at least one fin/tube block forms at least two mutually parallel flow ducts.

* * * * *